US008907585B2

(12) United States Patent
Kim et al.

(10) Patent No.: US 8,907,585 B2
(45) Date of Patent: Dec. 9, 2014

(54) METHOD OF DRIVING LIGHT SOURCE, LIGHT SOURCE MODULE FOR PERFORMING THE METHOD AND DISPLAY APPARATUS HAVING THE LIGHT SOURCE MODULE

(75) Inventors: Seung-Wan Kim, Asan-si (KR); Won-Sik Oh, Asan-si (KR); Young-Sup Kwon, Gwangmyeong-si (KR); Hwan-Woong Lee, Asan-si (KR)

(73) Assignee: Samsung Display Co., Ltd. (KR)

( * ) Notice: Subject to any disclaimer, the term of this patent is extended or adjusted under 35 U.S.C. 154(b) by 376 days.

(21) Appl. No.: 13/241,338

(22) Filed: Sep. 23, 2011

(65) Prior Publication Data

US 2012/0206057 A1 Aug. 16, 2012

(30) Foreign Application Priority Data

Feb. 16, 2011 (KR) ..... 2011-0013670

(51) Int. Cl.
*H05B 37/02* (2006.01)
*H05B 33/08* (2006.01)

(52) U.S. Cl.
CPC ..... *H05B 33/0815* (2013.01); *H05B 33/0842* (2013.01)
USPC ..... 315/291; 315/224; 315/307

(58) Field of Classification Search
USPC ..... 315/209 R, 224, 225, 247, 291, 307, 315/312, 324
See application file for complete search history.

(56) References Cited

U.S. PATENT DOCUMENTS

| | | | | |
|---|---|---|---|---|
| 8,344,638 | B2 * | 1/2013 | Shteynberg et al. | 315/247 |
| 8,421,424 | B2 * | 4/2013 | Ishii | 323/222 |
| 2004/0041620 | A1 | 3/2004 | D'Angelo et al. | |
| 2010/0320937 | A1 * | 12/2010 | Huang et al. | 315/297 |
| 2011/0080102 | A1 * | 4/2011 | Ge et al. | 315/200 R |

FOREIGN PATENT DOCUMENTS

| | | | |
|---|---|---|---|
| JP | 2006-174677 | A | 6/2006 |
| KR | 1020090073458 | A | 7/2009 |
| KR | 1020100067468 | A | 6/2010 |

* cited by examiner

*Primary Examiner* — Tung X Le
(74) *Attorney, Agent, or Firm* — Cantor Colburn LLP

(57) ABSTRACT

A method of driving a light source includes receiving an alternating current ("AC") voltage from outside, generating a first direct current ("DC") voltage based on the AC voltage, generating a second DC voltage, corresponding to a difference between a driving voltage of a light source part and the first DC voltage, based on the first DC voltage, and outputting a sum of the first DC voltage and the second DC voltage to the light source part.

17 Claims, 4 Drawing Sheets

METHOD OF DRIVING LIGHT SOURCE, LIGHT SOURCE MODULE FOR PERFORMING THE METHOD AND DISPLAY APPARATUS HAVING THE LIGHT SOURCE MODULE

This application claims priority to Korean Patent Application No. 2011-0013670, filed on Feb. 16, 2011, and all the benefits accruing therefrom under 35 U.S.C. §119, the content of which in its entirety is herein incorporated by reference.

BACKGROUND OF THE INVENTION

1. Field of the Invention

Exemplary embodiments of the present invention relate to a method of driving a light source, a light source module for performing the method and a display apparatus including the light source module. More particularly, exemplary embodiments of the present invention relate to a method of driving a light source with improved driving efficiency to decrease power consumption, a light source module for performing the method and a display apparatus including the light source module.

2. Description of the Related Art

Generally, a liquid crystal display apparatus has a thin thickness, a light weight and a low power consumption such that the liquid crystal display apparatus has been broadly used for various devices, such as a monitor, a laptop computer, a cellular phone and a television, for example. The liquid crystal display apparatus includes a liquid crystal display panel that displays an image using a light transmittance of liquid crystals and a light source module that provides light to the liquid crystal display panel. In the liquid crystal display apparatus, the light source module may be a backlight assembly, for example.

The light source module includes a plurality of light sources that generates light to display an image on the liquid crystal display panel. For example, the light sources may include at least one of a cold cathode fluorescent lamp ("CCFL"), an external electrode fluorescent lamp ("EEFL"), a flat fluorescent lamp ("FFL"), and a light emitting diode ("LED").

Recently, the LED, which has low power consumption and is eco-friendly, has been broadly used. The light source module includes a plurality of LED units, each of which includes a plurality of LEDs connected with each other, and a LED driver for driving the LED units.

The LED driver generates a driving voltage for driving the LED units. The LED driver typically performs a plurality of voltage converting processes to generate the driving voltage. In the voltage converting processes, energy loss and power consumption may be increased.

BRIEF SUMMARY OF THE INVENTION

Exemplary embodiments of the present invention provide a method of driving a light source with improved driving efficiency in a voltage converting process to decrease power consumption.

Exemplary embodiments of the present invention also provide a light source module for performing the method of driving the light source.

Exemplary embodiments of the present invention still also provide a display apparatus including the light source module.

In an exemplary embodiment of a method of driving a light source according to the present invention, the method includes receiving an alternating current ("AC") voltage from outside, generating a first direct current ("DC") voltage based on the AC voltage, generating a second DC voltage, corresponding to a difference between a driving voltage of a light source part and the first DC voltage, based on the first DC voltage, and outputting a sum of the first DC voltage and the second DC voltage to the light source part.

In an exemplary embodiment, the generating the first DC voltage may include converting the AC voltage into a third DC voltage, and converting the third DC voltage into the first DC voltage.

In an exemplary embodiment, the second DC voltage may be generated using a DC/DC converter, And the DC/DC converter may include a first input terminal which receives the first DC voltage, a second input terminal which receives a ground voltage, a first output terminal which outputs the sum of the first DC voltage and the second DC voltage, and a second output terminal connected to the first input terminal.

In an exemplary embodiment, the DC/DC converter may include a transformer having a first coil disposed at a primary side and a second coil disposed at a secondary side, and a dot end of the first coil and a dot end of the second coil are positioned at different sides in a circuit diagram.

In an exemplary embodiment, the DC/DC converter may include a transformer having a first coil disposed at a primary side and second coil disposed at a secondary side, and a dot end of the first coil and a dot end of the second coil are positioned at a same side in a circuit diagram.

In an exemplary embodiment, the generating the second DC voltage may include detecting a voltage at a cathode electrode of the light source part, and generating a control signal based on the voltage detected at the cathode electrode of the light source part.

In an exemplary embodiment, a light source module includes a light source part including a plurality of light emitting diodes, a system power source part which receives an alternating current (AC) voltage from outside, and generates a first direct current (DC) voltage based on the AC voltage, and a driving voltage generating part which generates a second DC voltage, corresponding to a difference between a driving voltage of the light source part and the first DC voltage, based on the first DC voltage, and outputs a sum of the first DC voltage and the second DC voltage to the light source part.

In an exemplary embodiment, the system power source part may include an AC/DC converter which converts the AC voltage into a third DC voltage, and a DC/DC converter which convert the third DC voltage into the first DC voltage.

In an exemplary embodiment, the driving voltage generating part may include a DC/DC converter, and the DC/DC converter may include a first input terminal which receives the first DC voltage, a second input terminal which receives a ground voltage, a first output terminal which outputs the sum of the first DC voltage and the second DC voltage, and a second output terminal connected to the first input terminal.

In an exemplary embodiment, the DC/DC converter may include a transformer including a first coil disposed at a primary side and a second coil disposed at a secondary side, and a dot end of the first coil and a dot end of the second coil are positioned at different sides in a circuit diagram.

In an exemplary embodiment, the DC/DC converter may further include a switching element connected between the first coil and the second input terminal, and a diode connected between the second coil and the first output terminal.

In an exemplary embodiment, the DC/DC converter may include a transformer including a first coil disposed at a primary side and a second coil disposed at a secondary side, and a dot end of the first coil and a dot end of the second coil are positioned at a same side in a circuit diagram.

In an exemplary embodiment, the DC/DC converter may further include a switching element, a first diode, a second diode and an inductor. The switching element may be connected between the first coil and the second input terminal. The first diode may be connected between the second coil and a first node. The second diode may be connected between the first node and the second output terminal. The inductor may be connected between the first node and the first output terminal.

In an exemplary embodiment, the light source module may further include a voltage detecting part connected to a cathode electrode of the light source part, where the voltage detecting part detects a voltage at the cathode electrode of the light source part, and a controlling part which generates a control signal for controlling the driving voltage generating part based on the voltage detected at the cathode electrode of the light source part.

In an exemplary embodiment, a display apparatus includes a display panel which displays an image, and a light source module including a light source part which provides light to the display panel and having a plurality of light emitting diodes, a system power source part which receives an AC voltage from outside, and generating a DC voltage based on the AC voltage, and a driving voltage generating part which generates part generates a second DC voltage, corresponding to a difference between a driving voltage of the light source part and the first DC voltage, based on the first DC voltage, and outputs a sum of the first DC voltage and the second DC voltage to the light source part.

In an exemplary embodiment, the driving voltage generating part may include a DC/DC converter including a first input terminal which receives the first DC voltage, a second input terminal which receives a ground voltage, a first output terminal which outputs the sum of the first DC voltage and the second DC voltage, and a second output terminal connected to the first input terminal.

In an exemplary embodiment, the DC/DC converter may include a transformer including a first coil disposed at a primary side and a second coil disposed at a secondary side, and a dot end of the first coil and a dot end of the second coil are disposed in different sides in a circuit diagram.

In an exemplary embodiment, the DC/DC converter may include a transformer including a first coil disposed at a primary side and a second coil disposed at a secondary side, and a dot end of the first coil and a dot end of the second coil are disposed in a same side in a circuit diagram.

In an exemplary embodiment, the light source part may be disposed facing a lower surface of the display panel.

In an exemplary embodiment, the light source module may further include a light guide plate which guides light to the display panel, and the light source part may be disposed facing a side surface of the light guide plate.

According to exemplary embodiments of the method of driving the light source, the light source module for performing the method and the display apparatus having the light source module, the driving voltage generating part generates a second DC voltage, corresponding to a difference between a driving voltage and a first DC voltage, such that energy efficiency is substantially improved. Thus, driving efficiency of the light source module is substantially improved such that power consumption of the light source module is substantially reduced.

BRIEF DESCRIPTION OF THE DRAWINGS

The above and other features and aspects of the present invention will become more apparent by describing in detailed exemplary embodiments thereof with reference to the accompanying drawings, in which.

DETAILED DESCRIPTION OF THE INVENTION

Figure 1:
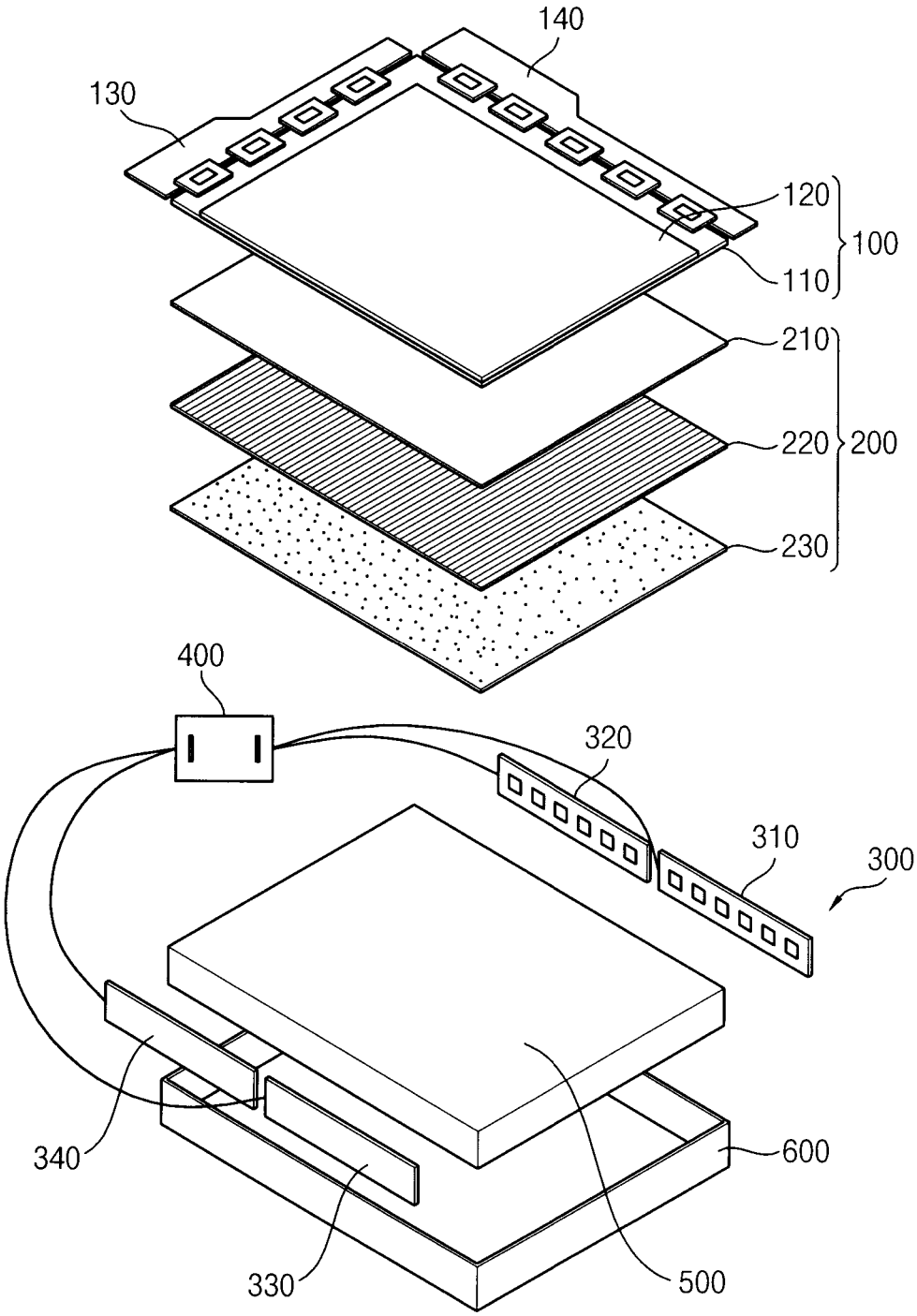
FIG. 1 is an exploded perspective view illustrating an exemplary embodiment of a display apparatus according to the present invention.

The foregoing is illustrative of the invention and is not to be construed as limiting thereof. Although a few exemplary embodiments of the invention have been described, those skilled in the art will readily appreciate that many modifications are possible in the exemplary embodiments without materially departing from the novel teachings and advantages of the invention. Accordingly, all such modifications are intended to be included within the scope of the invention as defined in the claims.

It will be understood that when an element or layer is referred to as being "on" or "connected to" another element or layer, the element or layer can be directly on or connected to another element or layer or intervening elements or layers. In contrast, when an element is referred to as being "directly on" or "directly connected to" another element or layer, there are no intervening elements or layers present. As used herein, "connected" includes physically and/or electrically connected. Like numbers refer to like elements throughout. As used herein, the term "and/or" includes any and all combinations of one or more of the associated listed items.

It will be understood that, although the terms first, second, third, etc., may be used herein to describe various elements, components, regions, layers and/or sections, these elements, components, regions, layers and/or sections should not be limited by these terms. These terms are only used to distinguish one element, component, region, layer or section from another region, layer or section. Thus, a first element, component, region, layer or section discussed below could be termed a second element, component, region, layer or section without departing from the teachings of the invention.

Spatially relative terms, such as "lower," "under," "above," "upper" and the like, may be used herein for ease of description to describe the relationship of one element or feature to another element(s) or feature(s) as illustrated in the figures. It will be understood that the spatially relative terms are intended to encompass different orientations of the device in use or operation, in addition to the orientation depicted in the figures. For example, if the device in the figures is turned over, elements described as "under" relative to other elements or features would then be oriented "above" relative to the other elements or features. Thus, the exemplary term "under" can encompass both an orientation of above and below. The device may be otherwise oriented (rotated 90 degrees or at other orientations) and the spatially relative descriptors used herein interpreted accordingly.

The terminology used herein is for the purpose of describing particular embodiments only and is not intended to be limiting of the invention. As used herein, the singular forms "a," "an" and "the" are intended to include the plural forms as well, unless the context clearly indicates otherwise. It will be further understood that the terms "comprises" and/or "comprising," when used in this specification, specify the presence of stated features, integers, steps, operations, elements, and/or components, but do not preclude the presence or addition of one or more other features, integers, steps, operations, elements, components, and/or groups thereof.

Unless otherwise defined, all terms (including technical and scientific terms) used herein have the same meaning as commonly understood by one of ordinary skill in the art to which this invention belongs. It will be further understood that terms, such as those defined in commonly used dictionaries, should be interpreted as having a meaning that is consistent with their meaning in the context of the relevant art and will not be interpreted in an idealized or overly formal sense unless expressly so defined herein.

All methods described herein can be performed in a suitable order unless otherwise indicated herein or otherwise clearly contradicted by context. The use of any and all examples, or exemplary language (e.g., "such as"), is intended merely to better illustrate the invention and does not pose a limitation on the scope of the invention unless otherwise claimed. No language in the specification should be construed as indicating any non-claimed element as essential to the practice of the invention as used herein.

Hereinafter, exemplary embodiments of the present invention will be described in further detail with reference to the accompanying drawings.

FIG. 1 is an exploded perspective view illustrating an exemplary embodiment of a display apparatus according to the present invention.

Referring to FIG. 1, an exemplary embodiment of the display apparatus includes a display panel 100, a light adjusting part 200, a light source part 300, a light source driver 400, a light guide plate 500 and a receiving container 600.

The display panel 100 displays an image. The display panel 100 includes a first substrate 110, a second substrate 120, a liquid crystal layer (not shown), a gate driver 130 and a data driver 140.

The first substrate 110 may include a thin film transistor.

The second substrate 120 faces the first substrate 110. The second substrate 120 may include a color filter (not shown).

The liquid crystal layer (not shown) is disposed between the first substrate 110 and the second substrate 120.

The gate driver 130 and the data driver 140 are connected to the first substrate 110 to output driving signals to the first substrate 110. The gate and data drivers 130 and 140 may include a flexible printed circuit board ("FPC"), a driving chip mounted on the FPC and a printed circuit board ("PCB") connected to an end of the FPC.

The light adjusting part 200 may include a protecting sheet 210, a prism sheet 220 and a diffusion sheet 230, for example, but not being limited thereto.

The protecting sheet 210 protects the prism sheet 220 from being scratched.

The prism sheet 220 may include a plurality of prisms disposed with a uniform gap on an upper surface. Each of the prisms may have a triangular shape. The prism sheet 220 condenses light diffused by the diffusion sheet 230 in a direction substantially perpendicular to the display panel 100.

The diffusion sheet 230 may include a base substrate and a coating layer disposed on the base substrate. The coating layer may include a bead. The bead may have a spherical shape. The diffusion sheet 230 diffuses light provided from the backlight assembly such that luminance uniformity is substantially improved.

The light source part 300 generates light. The light source part 300 may include a plurality of light source units, e.g., first to fourth light source units 310, 320, 330 and 340. The light source unit may include a plurality of light emitting diodes ("LED"s). The light source unit may include an LED string including the LEDs connected with each other in series.

The light source part 300 outputs the light generated therein to the light guide plate 500. The light source part 300 may be disposed facing at least one of side surfaces of the light guide plate 500.

In one exemplary embodiment, for example, the light source part 300 may be disposed facing each of two opposing long side surfaces of the light guide plate 500, e.g., a first long side surface and a second long side surface opposite to the first long side surface, as shown in FIG. 1. A first light source unit 310 and a second light source unit 320 may be disposed facing the first long side surface. A third light source unit 330 and a fourth light source unit 340 may be disposed facing the second long side surface opposite to the first long side surface.

In an alternative exemplary embodiment, the light source part 300 may be disposed facing one of the first and second long side surfaces of the light guide plate 500. In an exemplary embodiment, the light source part 300 may be disposed facing two opposing short side surfaces of the light guide plate 500, e.g., a first short side surface and a second short side surface opposite to the first short side surface. In an alternative exemplary embodiment, the light source part 300 may be disposed facing one of the first and second short side surfaces of the light guide plate 500. In an alternative exemplary embodiment, the light source part 300 may be disposed facing all side surfaces of the light guide plate 500.

The light source driver 400 drives the light source part 300. The light source driver 400 may be connected to the first to fourth light source units 310, 320, 330 and 340.

The light source driver 400 may be disposed outside the receiving container 600. In one exemplary embodiment, for example, the light source driver 400 may be disposed facing a rear surface of a bottom plate of the receiving container 600.

Hereinafter, an operation of the light source driver 400 will be explained in detail referring to FIGS. 2 to 4.

The light guide plate 500 guides a light generated from the light source part 300 to the display panel 100. The light guide plate 500 may include a rectangular parallelepiped shape. The light guide plate 500 may include a wedge shape in a cross-sectional view.

In an exemplary embodiment, the display apparatus may further include a reflective plate (not shown) disposed between the light guide plate 500 and the receiving container 600.

In an exemplary embodiment, the display apparatus may further include an upper receiving container (not shown) disposed on the display panel 100 and combined with the receiving container 600 and a mold frame (not shown) to improve rigidity of the display apparatus.

Although the display apparatus of the illustrated exemplary embodiment is an edge type display apparatus including the light source part 300 disposed facing at least one of the side surfaces of the light guide plate 500 corresponding to an edge of the display panel 100, the invention is not limited thereto. In an alternative exemplary embodiment, the display apparatus may be a direct type display apparatus including the light source part 300 facing a lower surface of the display panel 100. When the display apparatus is a direct type, the light guide plate 500 may be omitted.

Figure 2:
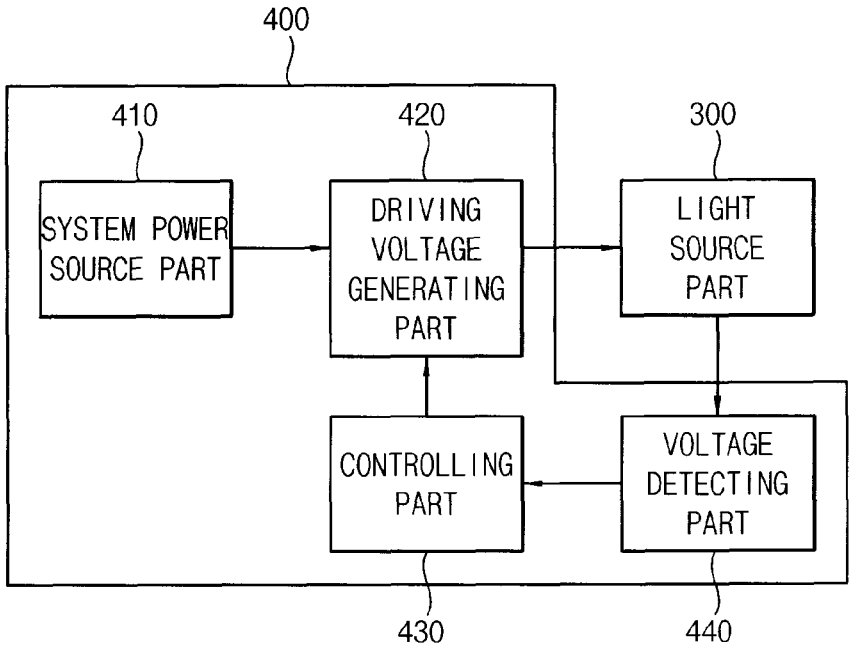
FIG. 2 is a block diagram illustrating an exemplary embodiment of a light source module of FIG. 1.

FIG. 2 is a block diagram illustrating an exemplary embodiment of a light source module of FIG. 1.

Referring to FIG. 2, the light source module includes the light source part 300 and the light source driver 400.

The light source driver 400 includes a system power source part 410, a driving voltage generating part 420, a controlling part 430 and a voltage detecting part 440.

The system power source part 410 receives an alternating current ("AC") voltage from outside to generate a first direct current ("DC") voltage. The system power source part 410 outputs the first DC voltage to the driving voltage generating part 420.

The driving voltage generating part 420 generates a second DC voltage, which is a difference between a driving voltage of the light source part 300 and the first DC voltage, based on the first DC voltage. The driving voltage generating part 420 outputs an output voltage, which is the sum of the first and second DC voltages, to the light source part 300.

The controlling part 430 generates a control signal for controlling the driving voltage generating part 420. The controlling part 430 outputs the control signal to the driving voltage generating part 420.

The controlling part 430 may control the driving voltage generating part 420 using a pulse width modulation ("PWM"). The controlling part 430 may include an integrated circuit ("IC") chip type. The control signal may be a PWM signal. The controlling part 430 may be connected to a gate electrode of a switching element to control turn-on duration of the switching element.

The voltage detecting part 440 detects a voltage of an end portion of the light source part 300. The voltage detecting part 440 may detect a voltage of a cathode of the LED in the light source part 300. The voltage detecting part 440 outputs the detected voltage to the controlling part 430. The controlling part 430 may generate the control signal based on the detected voltage.

The voltage detecting part 440 may include a transistor and a detecting resistor.

Figure 3:
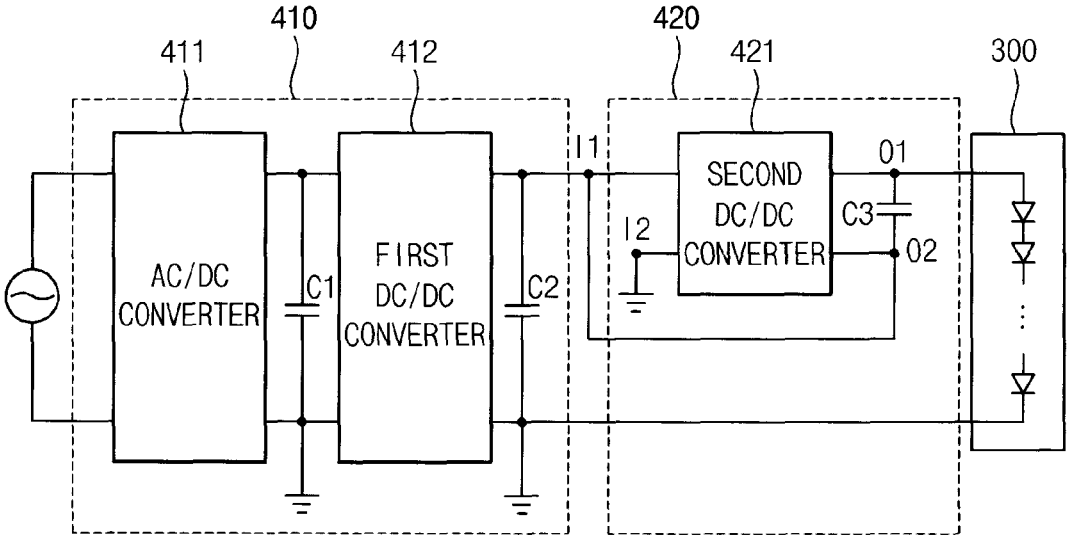
FIG. 3 is a block diagram illustrating an exemplary embodiment of a system power source part, a driving voltage generator and a light source part of FIG. 2.

FIG. 3 is a block diagram illustrating an exemplary embodiment of the system power source part 410, the driving voltage generator 420 and the light source part 300 of FIG. 2. In FIG. 3, the controlling part 430 and the voltage detecting part 440 in FIG. 2 are omitted for convenience of explanation.

In an exemplary embodiment, the light source part 300 includes the LED string including a plurality of LEDs connected with each other in series. An anode (+) of a first LED of the plurality of LEDs is connected to the driving voltage generating part 420 to receive the driving voltage for driving the LED string. A cathode (−) of the first LED is connected to an anode (+) of a second LED of the plurality of LEDs. A cathode (−) of the second LED is connected to an anode (+) of a third LED of the plurality of LEDs.

In an alternative exemplary embodiment, the light source part 300 may include a plurality of the LED strings. In such an embodiment, adjacent LED strings of the plurality of the LED strings may be connected to each other in parallel.

The system power source part 410 receives the AC voltage from outside, and generates the first DC voltage based on the AC voltage. The system power source part 410 includes an AC/DC converter 411 and a first DC/DC converter 412.

The AC/DC converter 411 converts the AC voltage from outside into a third DC voltage. In one exemplary embodiment, for example, the AC voltage may be about 220 volts (V). In an alternative exemplary embodiment, the AC voltage may be about 100 V. In one exemplary embodiment, for example, the third DC voltage may be several hundreds volts. In one exemplary embodiment, for example, the third DC voltage may be about 380 V.

The AC/DC converter 411 may include a power factor control part that adjusts a phase of the third DC voltage to improve power factor.

An output terminal of the AC/DC converter 411 may be connected to a first capacitor C1, and a level of the third DC voltage is thereby maintained.

The first DC/DC converter 412 converts the third DC voltage to the first DC voltage. The first DC voltage may be a standard voltage used for driving various electronic apparatuses. In one exemplary embodiment, for example, the first DC voltage may be several dozens volts. In one exemplary embodiment, for example, the first DC voltage may be about 24 V.

An output terminal of the first DC/DC converter 412 may be connected to a second capacitor C2, and a level of the first DC voltage is thereby maintained.

The driving voltage generating part 420 generates the second DC voltage, which is a difference of the driving voltage of the light source part 300 and the first DC voltage, based on the first DC voltage.

The driving voltage of the light source part 300 depends on the number of the LEDs in the light source part 300 and a unit driving voltage to drive a single LED. The driving voltage may be greater than the first DC voltage.

In one exemplary embodiment, for example, the driving voltage may be several dozens volts. In one exemplary embodiment, for example, the driving voltage may be about 40 V. In an alternative exemplary embodiment, the driving voltage may be about 28 V.

In an exemplary embodiment, when the driving voltage is about 40 V and the first DC voltage is about 24 V, the second DC voltage is about 16 V. In an alternative exemplary embodiment, when the driving voltage is about 28 V and the first DC voltage is about 24 V, the second DC voltage is about 4 V.

The driving voltage generating part 420 includes a second DC/DC converter 421.

The second DC/DC converter 421 includes a first input terminal I1, a second input terminal I2, a first output terminal O1 and a second output terminal O2.

The first input terminal I1 is connected to the output terminal of the first DC/DC converter 412. The first DC voltage is applied to the first input terminal I1. A ground voltage is applied to the second input terminal I2.

The first output terminal O1 outputs the output voltage that is the sum of the first and second DC voltages to the light source part 300. The output voltage is substantially equal to the driving voltage of the light source part 300. The first output terminal O1 may be connected to an anode of the first LED in the light source part 300.

The second output terminal O2 is connected to the first input terminal I1, and the first DC voltage generated by the first DC/DC converter 412 is applied to the second output terminal O2. Since the second output terminal O2 is connected to the first input terminal I1, although the second DC/DC converter 421 generates only the second DC voltage, the second DC/DC converter 421 may provide the driving voltage to the light source part 300.

In one exemplary embodiment, for example, when the driving voltage is about 40 V and the first DC voltage is about 24 V, the second DC/DC converter generates the second DC voltage of about 16 V based on the first DC voltage of about 24 V. The second DC/DC converter outputs the sum of the first DC voltage of about 24 V and the second DC voltage of about 16 V to the light source part 300. In such an embodiment, the output voltage that is the sum of the first and second DC voltages is substantially equal to the driving voltage for driving the LEDs in the light source part 300.

An energy efficiency of the second DC/DC converter 421 is calculated using the following Equation 1.

$$\eta 2' = 1 - \left(\frac{V2}{V1 + V2}\right)(1 - \eta 2) \quad \text{[Equation 1]}$$

Here, V1 denotes the first DC voltage, and V2 denotes the second DC voltage. η2 denotes an energy efficiency of the second DC/DC converter 421 when the second DC/DC converter 421 generates the sum of the first and second DC voltages. η2' is an energy efficiency of the second DC/DC converter 421 when the second DC/DC converter 421 generates only the second DC voltage.

In an exemplary embodiment, the second DC/DC converter 421 generates only the second DC voltage of 16 V based on the first DC voltage of 24 V instead of generating the driving voltage of 40 V based on the first DC voltage of 24 V. When η2 is 0.9, the energy efficiency of the second DC/DC converter 421 is η2'=1−(16/40)(1−0.9)=0.96. In such an embodiment, the second DC/DC converter 421 generates only the second DC voltage of 16 V, which is the difference between the driving voltage and the first DC voltage, such that the energy efficiency of the second DC/DC converter 421 is substantially improved compared to the second DC/DC converter 421 generating the driving voltage of 40 V.

When an energy efficiency of the first DC/DC converter 412 is 0.9 and the second DC/DC converter generates the driving voltage of 40 V, a total energy efficiency of the first and second DC/DC converters is 0.9*0.9=0.81. When the energy efficiency of the first DC/DC converter 412 is 0.9 and the second DC/DC converter 421 generates the second DC voltage of 16 V, a total energy efficiency of the first and second DC/DC converters 412 and 421 is increased to 0.9*0.96=0.864.

In an exemplary embodiment, when a power consumption of the second DC/DC converter generating the driving voltage of 40 V is 100 watts (W), a power consumption of the second DC/DC converter generating the second DC voltage of 16 V is 40 W. In such an embodiment, the second DC/DC converter 421 may include low capacity elements such that manufacturing cost of the second DC/DC converter 421 may be substantially decreased.

In one exemplary embodiment, for example, when the driving voltage is 28 V and the first DC voltage is 24 V, the second DC/DC converter generates the second DC voltage of 4 V based on the first DC voltage of 24 V. The second DC voltage outputs the sum of the first DC voltage of 24 V and the second DC voltage of 4 V to the light source part 300.

In such an embodiment, the second DC/DC converter 421 generates only the second DC voltage of 4 V based on the first DC voltage of 24 V instead of generating the driving voltage of 28 V based on the first DC voltage of 24 V. When η2 is 0.9, the energy efficiency of the second DC/DC converter 421 is η2'=1−(4/28)(1−0.9)≈0.986. The second DC/DC converter 421 generates only the second DC voltage of 4 V, which is the difference between the driving voltage and the first DC voltage, such that the energy efficiency of the second DC/DC converter 421 is substantially improved compared to the second DC/DC converter 421 that generates the driving voltage of 28 V.

When an energy efficiency of the first DC/DC converter 412 is 0.9 and the second DC/DC converter generates the driving voltage of 28 V, a total energy efficiency of the first and second DC/DC converters is 0.9*0.9=0.81. When the energy efficiency of the first DC/DC converter 412 is 0.9 and the second DC/DC converter 421 generates the second DC voltage of 4 V, a total energy efficiency of the first and second DC/DC converters 412 and 421 is increased to 0.9*0.986=0.887.

In such an embodiment, when a power consumption of the second DC/DC converter generating the driving voltage of 28 V is 100 W, a power consumption of the second DC/DC converter generating the second DC voltage of 4 V is about 14.29 W. In such an embodiment, the second DC/DC converter 421 may include low capacity elements such that a manufacturing cost of the second DC/DC converter 421 is substantially decreased.

Figure 4:
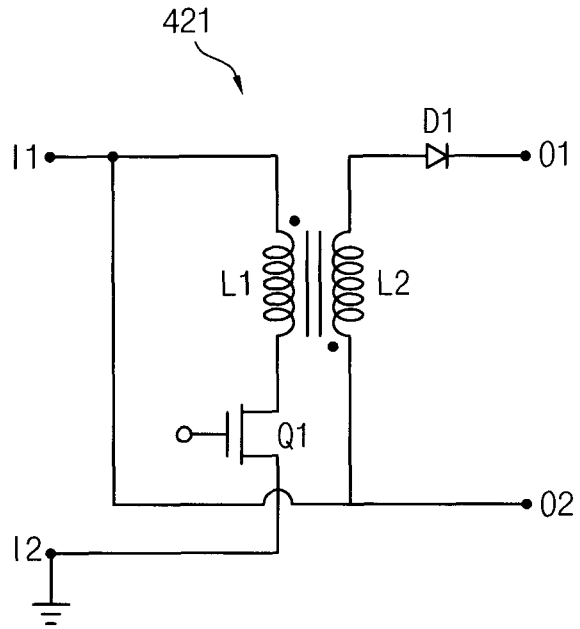
FIG. 4 is a circuit diagram illustrating an exemplary embodiment of a second DC/DC converter of FIG. 3.

FIG. 4 is a circuit diagram illustrating an exemplary embodiment of a second DC/DC converter of FIG. 3.

Referring to FIGS. 2 to 4, the second DC/DC converter 421 includes a transformer including a first coil disposed in a primary side and a second coil disposed in a secondary side. The primary and secondary sides are insulated from each other.

The first coil L1 includes a first end connected to the first input terminal and a second end opposite to the first end of the first coil L1. The second coil L2 includes a first end facing the first end of the first coil L1 and a second end opposite to the first end of the second coil L2.

The second DC voltage depends on a ratio of the number of coil turns in the first coil L1 and the number of coil turns in the second coil L2.

When the driving voltage is 40 V and the first DC voltage is 24 V, the second DC/DC converter 421 generates the second DC voltage of 16 V based on the first DC voltage of 24 V. The ratio of the number of coil turns in the first and second coils L1 and L2 may be about 3:2.

When the driving voltage is 28 V and the first DC voltage is 24 V, the second DC/DC converter 421 generates the second DC voltage of 4 V based on the first DC voltage of 24 V. The ratio of the number of coil turns in the first and second coils L1 and L2 may be about 6:1.

In an exemplary embodiment, the ratios of the number of coil turns in the first and second coils L1 and L2 are not limited to the above-described ratios. In an alternative exemplary embodiment, the ratios of the number of coil turns may be different from the above-described ratios.

The second DC/DC converter 421 includes a switching element Q1 connected between the first end of the first coil L1 and the second input terminal I2. The switching element Q1 may be a transistor.

A gate electrode of the switching element Q1 is connected to the controlling part 430, and receives the control signal from the controlling part 430. The switching element Q1 is turned on and turned off based on the control signal.

The second DC/DC converter 421 includes a diode D1 connected between the first end of the second coil L2 and the first output terminal O1. The diode D1 controls a direction of a current flow in the secondary side.

In an exemplary embodiment, as shown in FIG. 4, positions of dot ends of the first coil L1 and the second coil L2 are opposite to each other in the circuit diagram. A first dot of the first coil L1 is positioned at the first end of the first coil L1 connected to the first input terminal I1. A second dot of the second coil L2 is positioned at the second end of the second coil L2 connected to the second output terminal O2. In such an embodiment, a direction of a first magnetic flux generated inside the first coil L1 by a current flowing into the first end of the first coil L1 is substantially the same as a direction of a second magnetic flux generated inside the second coil L2 by a current flowing into the second end of the second coil L2. The second magnetic flux flows in a direction corresponding to the increasing magnetic field in the second coil L2 by the first magnetic flux.

Figure 5:
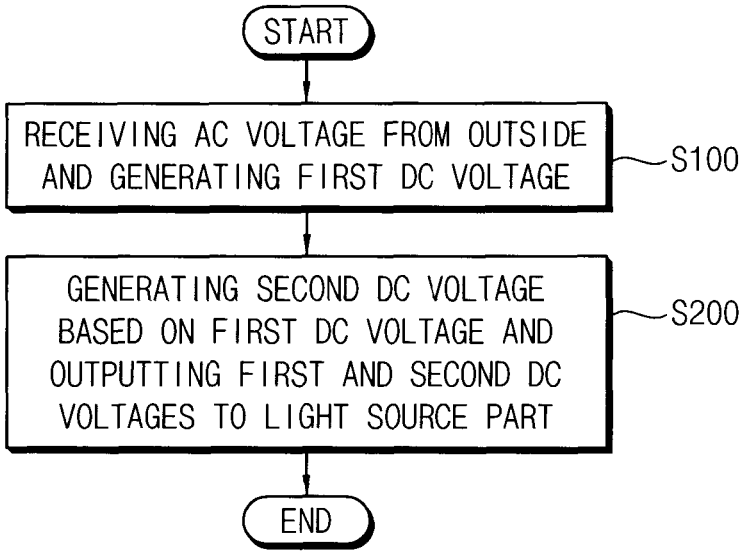
FIG. 5 is a flowchart illustrating an exemplary embodiment of a method of driving a light source module of FIG. 1.

FIG. 5 is a flowchart illustrating an exemplary embodiment of a method of driving a light source module of FIG. 1.

Referring to FIGS. 2 to 5, the system power source part 410 receives the AC voltage from outside, and generates the first DC voltage (step S100). The AC/DC converter 411 may convert the AC voltage into the third DC voltage. The first DC/DC converter 412 may convert the third DC voltage into the first DC voltage.

The driving voltage generating part 420 generates the second DC voltage, which is a difference between the driving voltage of the light source part 300 and the first DC voltage, based on the first DC voltage, and outputs the output voltage, which is the sum of the first and second DC voltages, to the light source part 300 (step S200).

The driving voltage generating part 420 includes a second DC/DC converter 421.

In an example embodiment, the driving voltage generating part 420 generates only the second DC voltage, which is a difference between the driving voltage and the first DC voltage, instead of generating the driving voltage. Thus, the energy efficiency is substantially improved.

In such an embodiment, the driving voltage generating part 420 may include low capacity elements such that a manufacturing cost may be substantially decreased.

Figure 6:
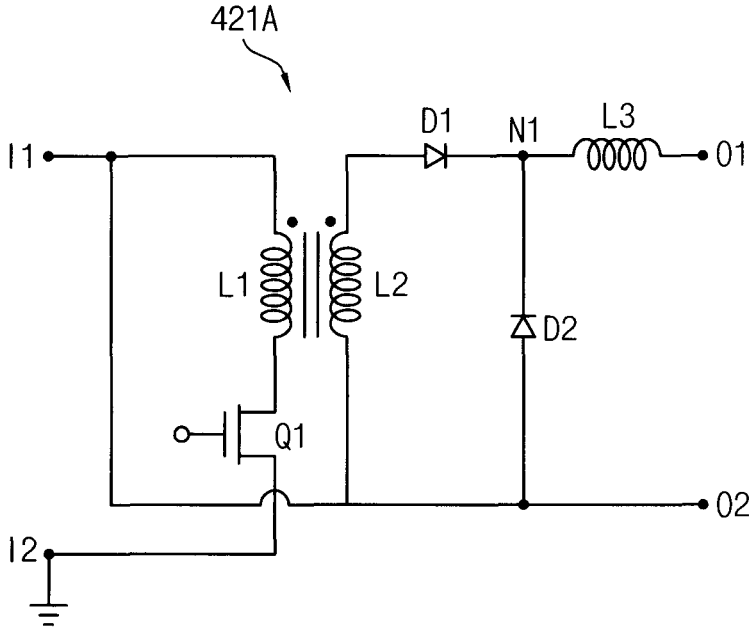
FIG. 6 is a circuit diagram illustrating an alternative exemplary embodiment of a second DC/DC converter according to the present invention.

FIG. 6 is a circuit diagram illustrating an alternative exemplary embodiment of the second DC/DC converter 421A according to the present invention.

An exemplary embodiment of the display apparatus including the second DC/DC convert 412A shown in FIG. 6 is substantially the same as the display apparatus shown in FIGS. 1 to 4 except for the second DC/DC converter 421A. The same or like elements shown in FIG. 6 have been labeled with the same reference characters as used above to describe the exemplary embodiments of the second DC/DC convert shown in FIG. 4, and any repetitive detailed description thereof will hereinafter be omitted or simplified.

Referring to FIGS. 2, 3 and 6, the second DC/DC converter 421A includes a transformer including a first coil disposed in a primary side and a second coil disposed in a secondary side. The primary and secondary sides are insulated from each other.

The first coil L1 includes a first end connected to the first input terminal and a second end opposite to the first end of the first coil L1. The second coil L2 includes a first end facing the first end of the first coil L1 and a second end opposite to the first end of the second coil L2.

The second DC voltage depends on a ratio of the number of coil turns in the first coil L1 and the number of coil turns in the second coil L2.

When the driving voltage is 40 V and the first DC voltage is 24 V, the second DC/DC converter 421A generates the second DC voltage of 16 V based on the first DC voltage of 24 V. The ratio of the number of coil turns in the first and second coils L1 and L2 may be about 3:2.

When the driving voltage is 28 V and the first DC voltage is 24 V, the second DC/DC converter 421A generates the second DC voltage of 4 V based on the first DC voltage of 24 V. The ratio of the number of coil turns in the first and second coils L1 and L2 may be about 6:1.

In an exemplary embodiment, the ratios of the number of coil turns are not limited to the above-described ratio. In an alternative exemplary embodiment, the ratios of the number of coil turns may be different from the above-described ratios in a practical circuit.

The second DC/DC converter 421A includes a switching element Q1 connected between the first end of the first coil L1 and the second input terminal I2. The switching element Q1 may be a transistor.

A gate electrode of the switching element Q1 is connected to the controlling part 430, and receives the control signal from the controlling part 430. The switching element Q1 is turned on and turned off based on the control signal.

The second DC/DC converter 421A includes a first diode D1 connected between the first end of the second coil L2 and a first node N1. The first diode D1 controls a direction of a current flow in the secondary side.

The second DC/DC converter 421A may further include a second diode D2 connected between the first node N1 and the second output terminal O2. The second diode D2 controls a direction of a current flow in the secondary side.

The second DC/DC converter 421A may further include an inductor L3 disposed between the first node N1 and the first output terminal O1.

In an exemplary embodiment, as shown in FIG. 6, positions of dot ends of the first coil L1 and the second coil L2 are facing each other in the circuit diagram. A first dot of the first coil L1 is positioned at the first end of the first coil L1 connected to the first input terminal I1. A second dot of the second coil L2 is positioned at the first end of the second coil L2 connected to the first diode D1. In such an embodiment, a direction of a first magnetic flux inside the first coil L1 generated by a current flowing into the first end of the first coil L1 is substantially the same as a direction of a second magnetic flux inside the second coil L2 generated by a current flowing into the first end of the second coil L2. The second magnetic flux flows in a direction corresponding to the increasing magnetic field in the second coil L2 by the first magnetic flux.

In an example embodiment, the driving voltage generating part 420 generates only the second DC voltage, which is a difference between the driving voltage and the first DC voltage, instead of generating the driving voltage. Thus, the energy efficiency is substantially improved.

In such an embodiment, the driving voltage generating part 420 may include low capacity elements such that a manufacturing cost may be substantially decreased.

According to exemplary embodiments set forth herein, the driving voltage generating part 420 generates the second DC voltage such that the energy efficiency may be substantially improved.

The foregoing is illustrative of the present invention and is not to be construed as limiting thereof. Although a few exemplary embodiments of the present invention have been described, those skilled in the art will readily appreciate that many modifications are possible in the exemplary embodiments without materially departing from the novel teachings and advantages of the present invention. Accordingly, all such modifications are intended to be included within the scope of the present invention as defined in the claims. In the claims, means-plus-function clauses are intended to cover the structures described herein as performing the recited function and not only structural equivalents but also equivalent structures. Therefore, it is to be understood that the foregoing is illustrative of the present invention and is not to be construed as limited to the specific exemplary embodiments disclosed, and that modifications to the disclosed exemplary embodiments, as well as other exemplary embodiments, are intended to be included within the scope of the appended claims. The present invention is defined by the following claims, with equivalents of the claims to be included therein.

What is claimed is:

1. A method of driving a light source, the method comprising:

receiving an alternating current (AC) voltage from outside;

generating a first direct current (DC) voltage based on the AC voltage;

generating a second DC voltage, corresponding to a difference between a driving voltage of a light source part and the first DC voltage, based on the first DC voltage; and outputting a sum of the first DC voltage and the second DC voltage to the light source part, wherein the second DC voltage is generated using a DC/DC converter, and the DC/DC converter comprises:

a first input terminal which receives the first DC voltage;

a second input terminal which receives a ground voltage;

a first output terminal which outputs the sum of the first DC voltage and the second DC voltage; and a second output terminal connected to the first input terminal.

2. The method of claim 1, wherein the generating the first DC voltage comprises:

converting the AC voltage into a third DC voltage; and converting the third DC voltage into the first DC voltage.

3. The method of claim 1, wherein the DC/DC converter further comprises a transformer having a first coil disposed at a primary side and a second coil disposed at a secondary side, and a dot end of the first coil and a dot end of the second coil are positioned at different sides in a circuit diagram.

4. The method of claim 1, wherein the DC/DC converter further comprises a transformer having a first coil disposed at a primary side and a second coil disposed at a secondary side, and a dot end of the first coil and a dot end of the second coil are positioned at a same side in a circuit diagram.

5. The method of claim 1, wherein the generating the second DC voltage comprises:

detecting a voltage at a cathode electrode of the light source part; and generating a control signal based on the voltage detected at the cathode electrode of the light source part.

6. A light source module comprising:

a light source part comprising a plurality of light emitting diodes;

a system power source part which receives an alternating current (AC) voltage from outside, and generates a first direct current (DC) voltage based on the AC voltage; and a driving voltage generating part which generates a second DC voltage, corresponding to a difference between a driving voltage of the light source part and the first DC voltage, based on the first DC voltage, and outputs a sum of the first DC voltage and the second DC voltage to the light source part, wherein the driving voltage generating part comprises a DC/DC converter, and the DC/DC converter comprises:

a first input terminal which receives the first DC voltage;

a second input terminal which receives a ground voltage;

a first input terminal which outputs the sum of the first DC voltage and the second DC voltage; and a second output terminal connected to the first input terminal.

7. The light source module of claim 6, wherein the system power source part comprises:

an AC/DC converter which converts the AC voltage into a third DC voltage; and a DC/DC converter which converts the third DC voltage into the first DC voltage.

8. The light source module of claim 6, wherein the DC/DC converter further comprises a transformer including a first coil disposed at a primary side and a second coil disposed at a secondary side, and a dot end of the first coil and a dot end of the second coil are positioned at different sides in a circuit diagram.

9. The light source module of claim 8, wherein the DC/DC converter further comprises:

a switching element connected between the first coil and the second input terminal; and a diode connected between the second coil and the first output terminal.

10. The light source module of claim 6, wherein the DC/DC converter further comprises a transformer including a first coil disposed at a primary side and a second coil disposed at a secondary side, and a dot end of the first coil and a dot end of the second coil are positioned at a same side in a circuit diagram.

11. The light source module of claim 10, wherein the DC/DC converter further comprises:

a switching element connected between the first coil and the second input terminal;

a first diode connected between the second coil and a first node;

a second diode connected between the first node and the second output terminal; and an inductor connected between the first node and the first output terminal.

12. The light source module of claim 6, further comprising:

a voltage detecting part connected to a cathode electrode of the light source part, wherein the voltage detecting part detects a voltage at the cathode electrode of the light source part; and a controlling part which generates a control signal for controlling the driving voltage generating part based on the voltage detected at the cathode electrode of the light source part.

13. A display apparatus comprising:

a display panel which displays an image; and a light source module comprising:

a light source part which provides light to the display panel and having a plurality of light emitting diodes;

a system power source part which receives an alternating current (AC) voltage from outside, and generating a first direct current (DC) voltage based on the AC voltage; and a driving voltage generating part which generates a second DC voltage, corresponding to a difference between a driving voltage of the light source part and the first DC voltage, based on the first DC voltage, and outputs a sum of the first DC voltage and the second DC voltage to the light source part, wherein the driving voltage generating part comprises a DC/DC converter, and the DC/DC converter comprises:

a first input terminal which receives the first DC voltage;

a second input terminal which receives a ground voltage;

a first input terminal which outputs the sum of the first DC voltage and the second DC voltage; and a second output terminal connected to the first input terminal.

14. The display apparatus of claim 13, wherein the DC/DC converter further comprises a transformer including a first coil disposed at a primary side and a second coil disposed at a secondary side, and a dot end of the first coil and a dot end of the second coil are disposed in different sides in a circuit diagram.

15. The display apparatus of claim 13, wherein the DC/DC converter further comprises a transformer including a first coil disposed at a primary side and a second coil disposed at a secondary side, and a dot end of the first coil and a dot end of the second coil are disposed in a same side in a circuit diagram.

16. The display apparatus of claim 13, wherein the light source part is disposed facing a lower surface of the display panel.

17. The display apparatus of claim 13, wherein the light source module further comprises a light guide plate which guides light to the display panel, and the light source part is disposed facing a side surface of the light guide plate.

* * * * *